United States Patent [19]

Wood

[11] 4,193,431

[45] Mar. 18, 1980

[54] FENCE SLAT CUTTING METHOD AND APPARATUS

[76] Inventor: Paul R. Wood, 3602 N. 35th Ave., Phoenix, Ariz. 85017

[21] Appl. No.: 906,821

[22] Filed: May 17, 1978

[51] Int. Cl.[2] ..... B27C 5/00

[52] U.S. Cl. ..... 144/134 C; 144/2 R; 144/245 A; 144/323; 198/607

[58] Field of Search ..... 83/435.2, 423, 425, 83/425.1, 425.2, 425.3, 477, 410, 411 R, 411 A, 401, 409, 409.1, 409.2, 477, 477.1, 432; 144/2 R, 3 R, 3 M, 134 R, 136 R, 136 G, 242 R, 242 H, 245 R, 245 A, 245 B, 312, 323, 134 C, 30; 90/11 R, 19; 198/607; 214/1 P

[56] References Cited

U.S. PATENT DOCUMENTS

| | | | |
|---|---|---|---|
| 1,823,272 | 9/1931 | Johnson | 144/245 A |
| 3,162,292 | 12/1964 | Lawson | 144/245 R |
| 3,528,338 | 9/1970 | Cuma | 90/11 R X |
| 3,689,269 | 8/1972 | Fritz et al. | 198/127 |
| 3,719,216 | 3/1973 | Tracy | 144/30 |
| 4,044,748 | 8/1977 | Villanveva | 198/339 K |

FOREIGN PATENT DOCUMENTS

| | | | |
|---|---|---|---|
| 563261 | 8/1944 | United Kingdom | 144/245 A |

*Primary Examiner*—Robert L. Spruill
*Assistant Examiner*—W. D. Bray
*Attorney, Agent, or Firm*—Warren F. B. Lindsley

[57] ABSTRACT

A method and apparatus for feeding a plurality of juxtapositioned fence slat material on an orientation conveyor to an infeed elevator conveyor for aligning, holding in place and feeding against the resistance of a cutting means a similar end of each slat, the cutting means comprising a pair of spaced cooperating cylindrical saw blades for forming one end of each slat in a like manner.

2 Claims, 5 Drawing Figures

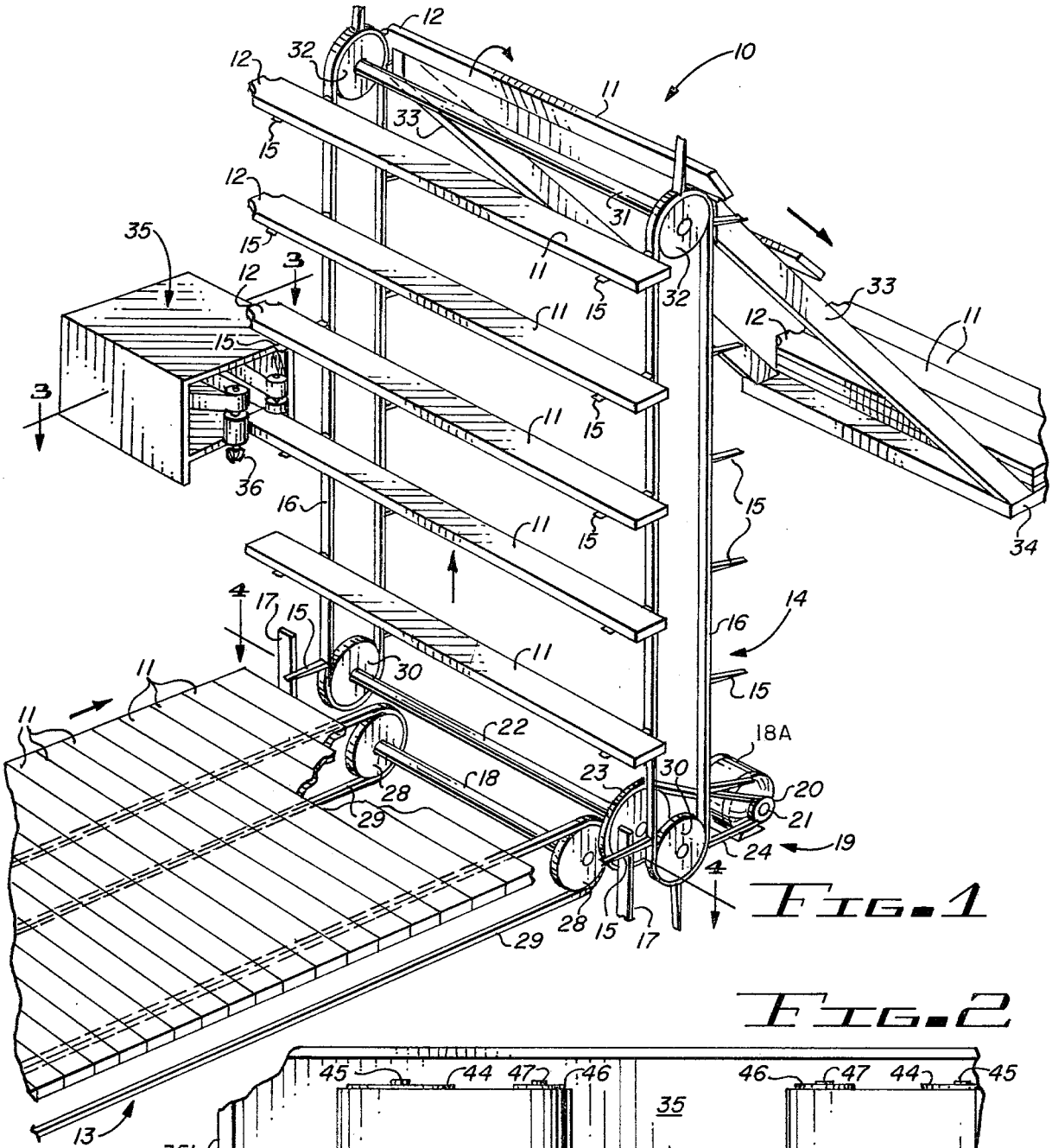
FIG. 1
FIG. 2
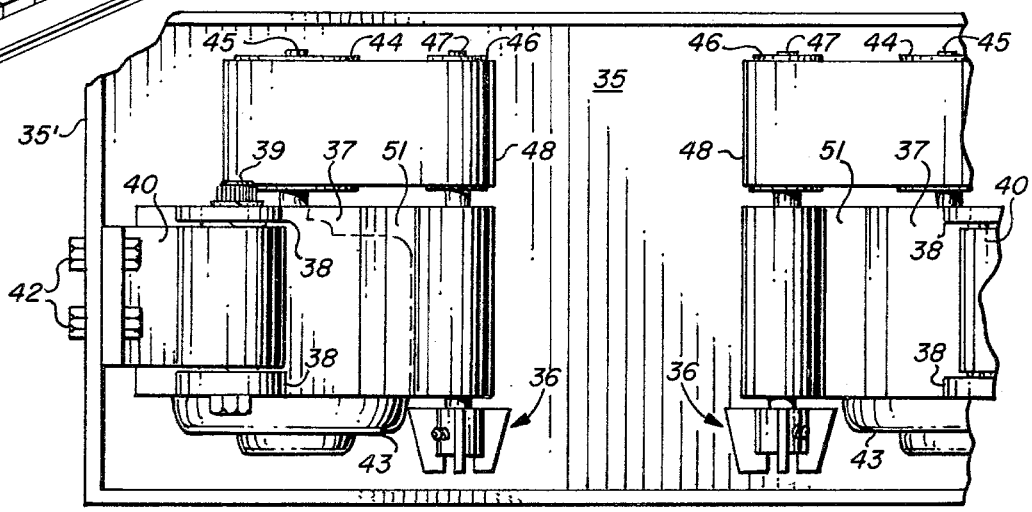

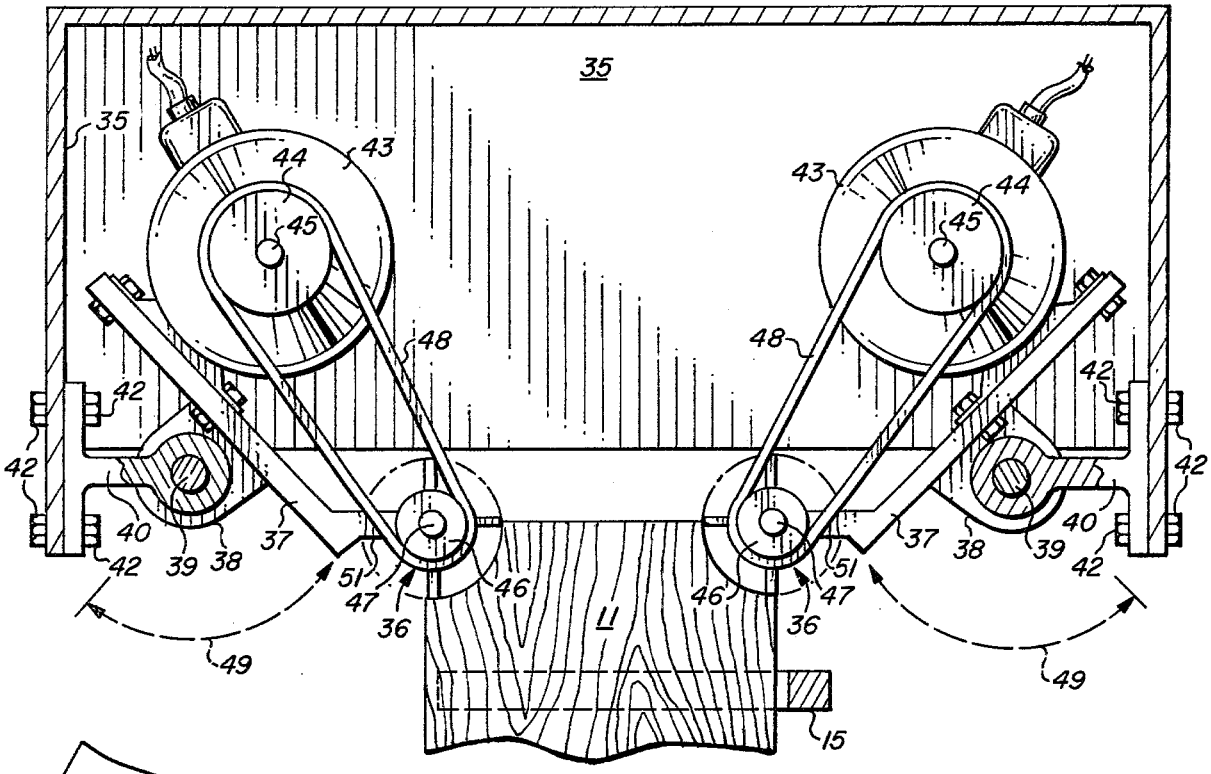
FIG. 3
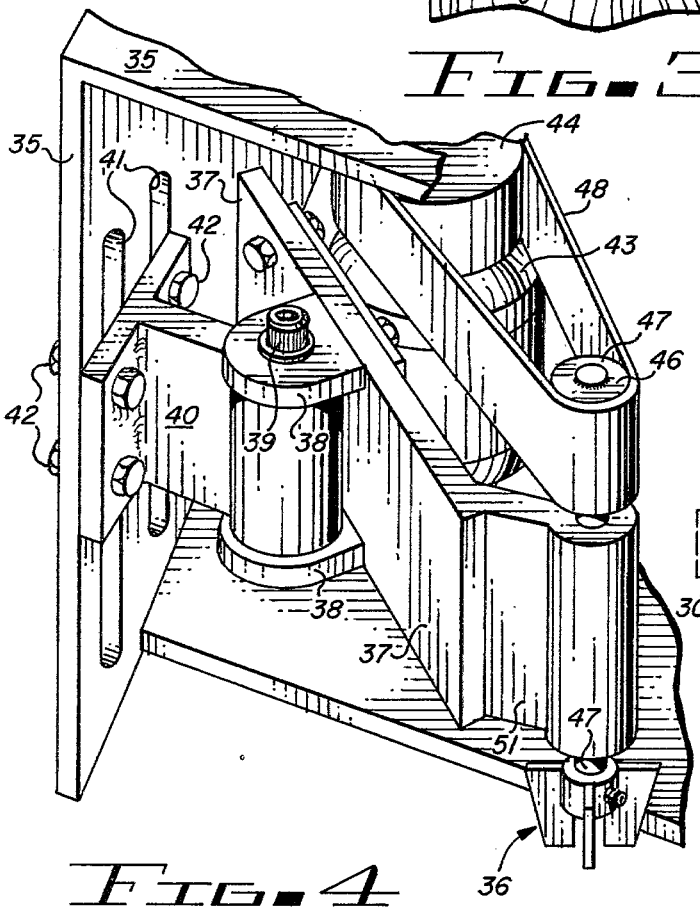
FIG. 4
FIG. 5
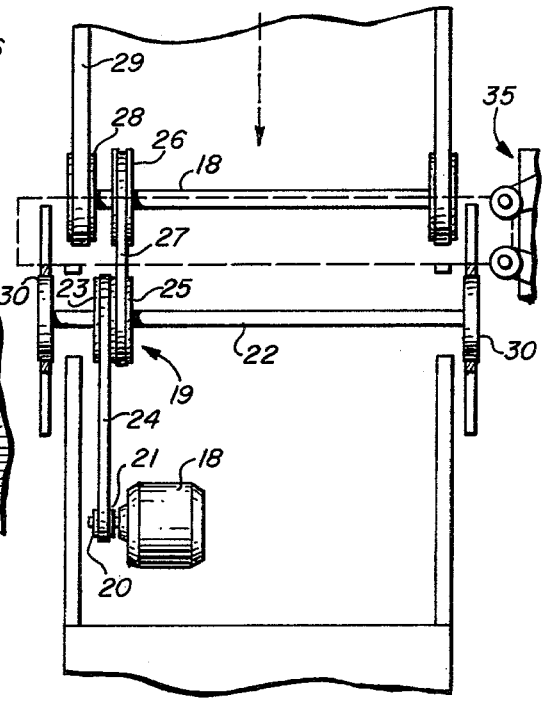

FENCE SLAT CUTTING METHOD AND APPARATUS

BACKGROUND OF THE INVENTION

This invention relates to the end forming of slats of like size on a production line basis so that they can, with a minimum of handling, be used for fences or the like.

The processing of lumber involving handling, edging or end forming using one or a battery of forming means, such as saw blades and the like, must be mechanised if the cost is to be kept to a minimum.

The prior art need for having a separate specialized and expensive saw apparatus to perform the edging or end forming of the slats used in a slat fence has required a tremendous outlay of capital and large amounts of floor space which many small mill owners cannot afford. Moreover, such prior operations required skilled labor which is prohibitive for this type of merchandise.

DESCRIPTION OF THE PRIOR ART

Although U.S. Pat. Nos. 3,528,338; 3,687,269 and 4,044,748 disclose methods and apparatus for cutting and forming building materials including conveyor means for assembly and moving the material, such as lumber, along a given path to a cutting means, none of them disclose a simple, economical yet highly productive one man operated apparatus for end forming wooden slats operable by unskilled help.

SUMMARY OF THE INVENTION

In accordance with the present invention, the need for highly specialized sawing apparatus for forming the ends of slats for slatted fence use involving the use of skilled help is eliminated through the use of a single pair of adjustably positioned wood forming means which in combination with a unique infeed conveyor handles, positions and holds firmly each slat individually as it is fed through a cutting means on its way to a discharge conveyor.

It is, therefore, one object of this invention to provide an improved fence slat cutting method and apparatus for assembling, positioning, passing individually similar ends of each slat under pressure through a pair of cooperating sawing means and continuing the movement of the slats on the same infeed conveyor to a discharge assembly position.

Another object of this invention is to provide an improved simple and economical means for assembly, holding and end cutting under pressure a continuous supply of slats for a slatted fence with a minimum of unskilled labor.

A further object of this invention is to provide an improved slat cutting apparatus for providing similarly formed ends on the slats and employing adjustably positioned cylindrical cutting blades for adjusting the shapes of the ends of the slats.

A still further object of this invention is to provide an infeed conveyor which individually positions, holds and feeds the material under pressure through a pair of end forming means and maintains control of each slat individually after the forming operation until a point downstream therefrom.

A still further object of this invention is to provide and maintain exact alignment of a pair of spacedly adjustable cylindrical saw blades with the material and which simplifies adjustment of the saw blades for varying type of cuts, if necessary.

A still further object of this invention is to provide a simple, one man operable machine and method for processing slats for wooden fences which occupies a minimum of floor space and is economical to manufacture, operate and maintain.

These and other objects and advantages of this invention will become more apparent as the description is given and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings of which:

FIG. 1 is a partial perspective schematic view of an end forming apparatus for wooden slats and embodying the invention;

FIG. 2 is an enlarged top view of the cutting means shown in FIG. 1;

FIG. 3 is a cross-sectional view of FIG. 1 taken along the lines 3—3;

FIG. 4 is a cross-sectional view of FIG. 1 taken along the line 4—4; and

FIG. 5 is a schematic top view of the apparatus shown in FIG. 1.

DESCRIPTION OF THE PREFERRED EMBODIMENT

Referring more particularly to the drawings by characters of reference, FIGS. 1–5 disclose an apparatus 10 for assembly, holding, conveying and forming similar ends of a plurality of pieces of building material, such as wooden slats 11, so that each slat has a similarly formed end 12.

FIG. 1 discloses a horizontal conveyor 13 on which are placed and aligned in a side by side arrangement a plurality of slats 11 havin similar usually rectangular shapes. The conveyor 13 is so positioned that it feeds individually the slats onto a laterally positioned conveyor 14.

Conveyor 14 which may be vertically positioned is provided with a plurality of spaced pairs of arms 15 extending laterally from a pair of endless belts 16. Belts 16 which are spacedly arranged from each other a suitable distance depending on the length of the slats being handled are mounted on a frame 17 of the machine or apparatus only a small portion of which is shown for reasons of clarity.

As shown in FIGS. 1 and 5, each of the conveyors 13 and 14 comprise drive and driven shafts. Conveyor 13 comprises a drive shaft 18 suitably journaled on frame 17 for driving a driven shaft (not shown) by a drive motor 18A through a suitable drive train 19. Drive train 19 comprises a sprocket 20 fixedly mounted on a rotatable shaft 21 of motor 18A which drives a drive shaft 22 forming a part of conveyor 14 by means of a sprocket 23 fixedly mounted on drive shaft 22 and a belt drive 24 interconnecting these sprockets in a well known manner. A further sprocket 25 mounted on drive shaft 22 is interconnected with a sprocket 26 fixedly mounted on drive shaft 18 of conveyor 13 by a belt drive 27.

Drive shaft 18 of conveyor 13 drives its cooperating driven shaft (not shown) through a pair of sprockets 28 and a pair of belts 29 in the usual manner. Although a single motor 18 and drive train 19 is shown for providing cooperative action between conveyors 13 and 14, it should be noted that individual motors and drive trains may be provided for each conveyor system, if so desired.

The drive shaft 22 of conveyor 14 is provided with a pair of sprockets 30 fixedly mounted thereon for rotation therewith which sprockets are interconnected in a driving manner with a vertically arranged spacedly positioned driven shaft 31 by means of pulley belt 16 and sprockets 32 fixedly attached thereto.

As noted from FIG. 1, when the slats 11 carried by arms 15 on belts 16 reach driven shaft 31 and move around the periphery of sprockets 32, the slats are released by arms 15 on belts 16 to slide down a ramp formed by slide rails 33 to an off platform or conveyor 34.

It should be noted that the upright parts of frame 17 shown in FIG. 1 from a stop for the slats 11 being moved by conveyor 13 to conveyor 14.

In this manner, the slats come to rest on arms 15 of belts 16 in a given position ready for movement to and through the slat end forming means 35.

The end forming means 35 comprises a pair of adjustably mounted cylindrical end forming cutters 36 each of which when rotated simultaneously cut or form a part of the end of a given slat. Each of these cutters 36 are journaled on an arm 37 forming a part on the end forming means 35 which in turn is mounted on frame 17 of apparatus 10. A pair of spaced flanges 38 of arms 37 are pivotally mounted on and rotatably adjusted by a swivel shaft and nut arrangement 39 to a bracket 40 shown in FIG. 4. Bracket 40 may be adjustably mounted in one of a plurality of vertical positions along a pair of vertical slots 41 in the end forming means by a plurality of adjustment bolt and nut arrangement 42 in a manner obvious from the illustration shown in FIG. 4.

Each of the rotatably mounted cutters 36 are independently rotated by its associated motor 43 through a sprocket 44 mounted on its shaft 45 and a sprocket 46 mounted on the shaft 47 of the cutter 36 by means of the associated drive belts 48.

As shown, the position of the cutter 36 in the slat end forming means 35 may be adjustably positioned relative to the associated cutter 36 and the arm 37 of the end forming means to control the amount of cutting on the slat so as to vary its end configuration. This adjustment feature of the end forming means is diagrammatically illustrated by the arrows 49 in FIG. 3.

FIG. 4 also illustrates that each of the cutters 36 are replaceably positioned on shaft 47 which is journaled in a laterally extending arm member or portion 51 of arm 37.

In operation, slats 11 are juxtapositioned on conveyor 13 for movement in the manner shown in FIG. 1 individually on arm 15 of belt 16 and up to frame 17. As arms 15 and belt 16 move vertically forming a part of conveyor 14, the slats 11 are individually and spacedly elevated between the adjustably positioned cutters 36.

It should be noted that the slats are adjustably positioned on conveyor 13 so that they are parallelly arranged and aligned so that their ends lie substantially in the same plane thereby assuring that the formed ends of the slats are similar in configuration because they extended between the cutters all substantially the same distance.

Although the end configurations are shown having a given design configuration, other shapes may be obtained from the method and apparatus shown by merely changing the cutter configuration.

Although but one embodiment of the present invention has been illustrated and described, it will be apparent to those skilled in the art that various changes and modifications may be made therein without departing from the spirit of the invention or from the scope of the appended claims.

What is claimed is:

1. An apparatus for cutting the ends of slats for wooden fence use comprising:

a first endless conveyor means for sequentially aligning and moving a plurality of juxtapositioned wooden slats along a given path onto a second endless laterally positioned conveyor means, said second endless conveyor means aligned at the discharge end of said first conveyor means for sequentially moving the slats along a given path in a horizontal position through an end forming means for the slats, said end forming means for the slats compising a pair of spaced relatively adjustably positioned rotating cutter blade means for simultaneously machining between them different corresponding edges of like ends of the slats as they are sequentially moved by said second conveyor means in substantially a vertical direction between said cutter blade means, said blade means being spaced from each other a distance less than the width of the slats with at least one of said cutter blade means being journaled on a pivotally mounted arm for adjustably positioning it relative to the other cutter blade means for varying the machine design configuration of the end of the slats, the blades of said cutter blade means rotating about a shaft substantially perpendicular to the direction of movement of the slats through said cutter blade means, whereby the surfaces of the slats are milled away by the blades, a pair of electric motor means each connected to a different one of said blade means for rotation thereof independently of any means for moving said first and second conveyor means, and means arranged at the end of said second conveyor means for receiving the slats machined by said apparatus.

2. The apparatus set forth in claim 1 wherein:

each of said cutter blade means is journaled on a pivotally mounted arm for adjustably positioning it relative to the other cutter blade means for varying the design configuration of the ends of the slats.

* * * * *